US007673581B2

(12) United States Patent
Ueberschär

(10) Patent No.: US 7,673,581 B2
(45) Date of Patent: Mar. 9, 2010

(54) APPLICATION DEVICE

(75) Inventor: Manfred Ueberschär, Gerstetten (DE)

(73) Assignee: Voith Patent GmbH, Heidenheim (DE)

( * ) Notice: Subject to any disclaimer, the term of this patent is extended or adjusted under 35 U.S.C. 154(b) by 520 days.

(21) Appl. No.: 10/582,740

(22) PCT Filed: Dec. 15, 2004

(86) PCT No.: PCT/EP2004/053490

§ 371 (c)(1),
(2), (4) Date: Jun. 13, 2006

(87) PCT Pub. No.: WO2005/058511

PCT Pub. Date: Jun. 30, 2005

(65) Prior Publication Data

US 2007/0144432 A1 Jun. 28, 2007

(30) Foreign Application Priority Data

Dec. 17, 2003 (DE) ..... 103 59 122

(51) Int. Cl.
*B05B 13/02* (2006.01)

(52) U.S. Cl. ..... 118/325; 118/262; 118/411; 118/602; 118/603; 118/610

(58) Field of Classification Search ..... 118/410, 118/411, 325, DIG. 4, 602, 429, 419, 603, 118/610, 262, 266–267, 313, 315; 427/420, 427/402

See application file for complete search history.

(56) References Cited

U.S. PATENT DOCUMENTS

| | | | | | |
|---|---|---|---|---|---|
| 2,428,284 | A | * | 9/1947 | Krogel | 118/314 |
| 4,230,743 | A | * | 10/1980 | Nakamura et al. | 427/146 |
| 4,479,987 | A | * | 10/1984 | Koepke et al. | 427/402 |
| 4,559,896 | A | | 12/1985 | Bossard et al. | 118/300 |
| 5,105,758 | A | * | 4/1992 | Kozak | 118/300 |
| 5,885,659 | A | * | 3/1999 | Takahashi et al. | 427/420 |
| 2002/0066404 | A1 | * | 6/2002 | Ueberschar et al. | 118/261 |

FOREIGN PATENT DOCUMENTS

| | | |
|---|---|---|
| DE | 17 35 852 | 12/1955 |
| DE | 31 35 819 | 3/1983 |
| DE | 32 41 831 | 5/1984 |
| DE | 198 23 686 | 1/1999 |

* cited by examiner

*Primary Examiner*—Brenda A Lamb
(74) *Attorney, Agent, or Firm*—Taylor & Aust, P.C.

(57) ABSTRACT

A device for the application of at least two liquid to pasty application media to one or both sides of a moving surface, having a curtain applicator for applying the application media. The curtain applicator discharges the application media onto the moving surface as curtains moving substantially under the force of gravity, and the moving surface being one of a surface of a material web and a surface of a transfer element, which transfers the application media to the surface of the material web. The device includes a collecting device for the separate collection of each application medium. The collecting device being positionable between the curtain applicator and the material web. The curtain applicator and the collecting device being movable relative to each other.

18 Claims, 3 Drawing Sheets

APPLICATION DEVICE

BACKGROUND OF THE INVENTION

1. Field of the Invention

The present invention relates to a device for the application of at least two liquid or pasty application media to one or both sides of a moving surface, having a curtain applicator for applying the application media. The curtain applicator discharges the application media onto the moving surface as curtains moving substantially under the force of gravity. The surface, in the case of direct application, being the surface of a material web, in particular of paper or board. In the case of indirect application the surface being a transfer element, for example an applicator roll, which transfers the application media to the surface of the material web.

2. Description of the Related Art

Curtain applicators, with which a plurality of application media can be applied, are generally known from the prior art. In these known curtain applicators, the application media are collected together by a tray. The tray is arranged between the curtain applicator and the moving surface, so that it is used when starting up or stopping the curtain applicator, or for producing uncoated edges on the moving surface. Since the application media are collected together by the tray, they mix in the tray. Therefore, the expensive application media can no longer be used for further coating. Separation of the application media from one another can be implemented only in a very complicated manner and is thus expensive. The mixed application media therefore have to be disposed of, which result in further high costs.

What is needed in the art is a cost effective media recovery system.

SUMMARY OF THE INVENTION

The present invention provides an improved device to the effect that the application media can be used again after being collected and no longer have to be disposed of.

The invention achieves this objective by way of a curtain applicator according to the present invention, and a collecting device for the separate collection of each application medium positioned between the curtain applicator and the material web. The curtain applicator and the collecting device can be moved relative to each other. Since the collecting device collects the various application media separately, the media cannot mix. They can therefore be used again for a further coating operation and no longer have to be disposed of. As a result, both the high procurement costs for the application media are reduced and the disposal costs are saved.

A discharge device is arranged on the collecting device. The application media collected can then be led away from the collecting device in order to be available again for the coating operation. In order to be able to pass the application media on from the collecting device to the discharge device, the collecting device can be equipped with discharge openings to pass the application media to the discharge device. The collecting device has inclines arranged above the discharge openings, so that the application media can be led to the discharge openings by way of the inclines.

So that the application media can be collected separately by the collecting device, the collecting device is subdivided into a plurality of mutually adjacent sections, each of the sections holding only one application medium. The mutually adjacent sections of the collecting device can be separated from one another by a separating element. This ensures that the various application media do not mix with one another.

The discharge openings in one section are adjacent to the inclines on the adjacent section. Then, the application medium, picked up by one of the sections, can flow off into the discharge openings of this respective section and flow under the inclines of the adjacent section adjacent to the discharge openings, in order to be fed to the discharge device. In this way, the inclines fulfill a further function in that, by way of the inclines, various application media can cross without the crossing application media mixing with one another.

In order to lead the application media coming from the collecting device away separately from one another, the discharge device can have a discharge plate, at the end of which there is arranged a separate drainage channel for each application medium.

In order that the various application media cannot mix with one another on the discharge plate, the discharge plate has at least one separate channel for each application medium. The channels of the discharge plate bridge at least one of the drainage channels located beside one another at the end of the discharge plate. Then one of the application media, which is carried in the bridging channel of the discharge plate, crosses at least one of the other application media at the transition from the discharge plate to the drainage channel. As a result of this crossing, mixing of the two application media is reliably ruled out. In order to rule out a mixing of the application media on the discharge plate, it is advantageous if the channels are separated from one another by a metal sheet.

The discharge plate can have a gradient, in order to be able to carry away the application media as quickly as possible. A satisfactory discharge flow is achieved with a gradient of at least five degrees. The application media can preferably be carried away to the side on which the drives are placed. Then, from the other side, on which an operator's desk is located, the device can be monitored freely by the operating personnel of the operator's desk. In principle, however, the application media can be carried away on either or both sides of the device.

The collecting device and the discharge device can be formed in one piece. As a result, the entire unit including a collecting device and a discharge device becomes very dimensionally stable, so that reliable discharge of the application media is provided.

In another embodiment of the present invention, it is also possible for the collecting device and the discharge device to be separate components. Then only the collecting device need be removed in order to begin or end the coating operation. The discharge device and discharge hoses connected to the latter can then remain in place, so that overall a smaller mass has to be moved. In this case, only a relatively small drive is required for the collecting device. In addition, the collecting device can be moved more quickly under the curtain or moved away under the curtain if the mass to be moved is smaller.

The collecting device can have two sections which can be moved in opposite directions in a longitudinal direction of the material web. Minimal mixing of the application media when the coating operation is started or ended is then ruled out absolutely. However, minimal mixing of the application media occurs if the sections are moved in the same direction at the start or at the end of the coating operation.

In a particular embodiment of the present invention, the separating element arranged between the sections can have a deflection device for deflecting the application media into the various sections. Then, at the start or at the end of the coating operation, minimal mixing of the application media is ruled out, since the deflection device deflects the respective application medium into the respective section as the collecting device is moved. The deflection device can be pivoted appropriately on the basis of the direction of movement of the web and the movement travel covered, in order to conduct the application medium optimally into the section provided for the purpose.

If a lower collecting device is provided under the material web, the application media can also be collected in the event of a break in the material web. Since the movable collecting device cannot be moved under the curtain quickly enough in the event of a break in the material web, the lower collecting device is particularly advantageous. In a development of the present invention, the application media can likewise be collected separately by the lower collecting device.

In one preferred embodiment of the present invention, the lower collecting device has a separate channel for each application medium, in order to be able to collect the application media separately.

In order to rule out undesired mixing of the application media, the channels can be separated from one another, for example by separating elements.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
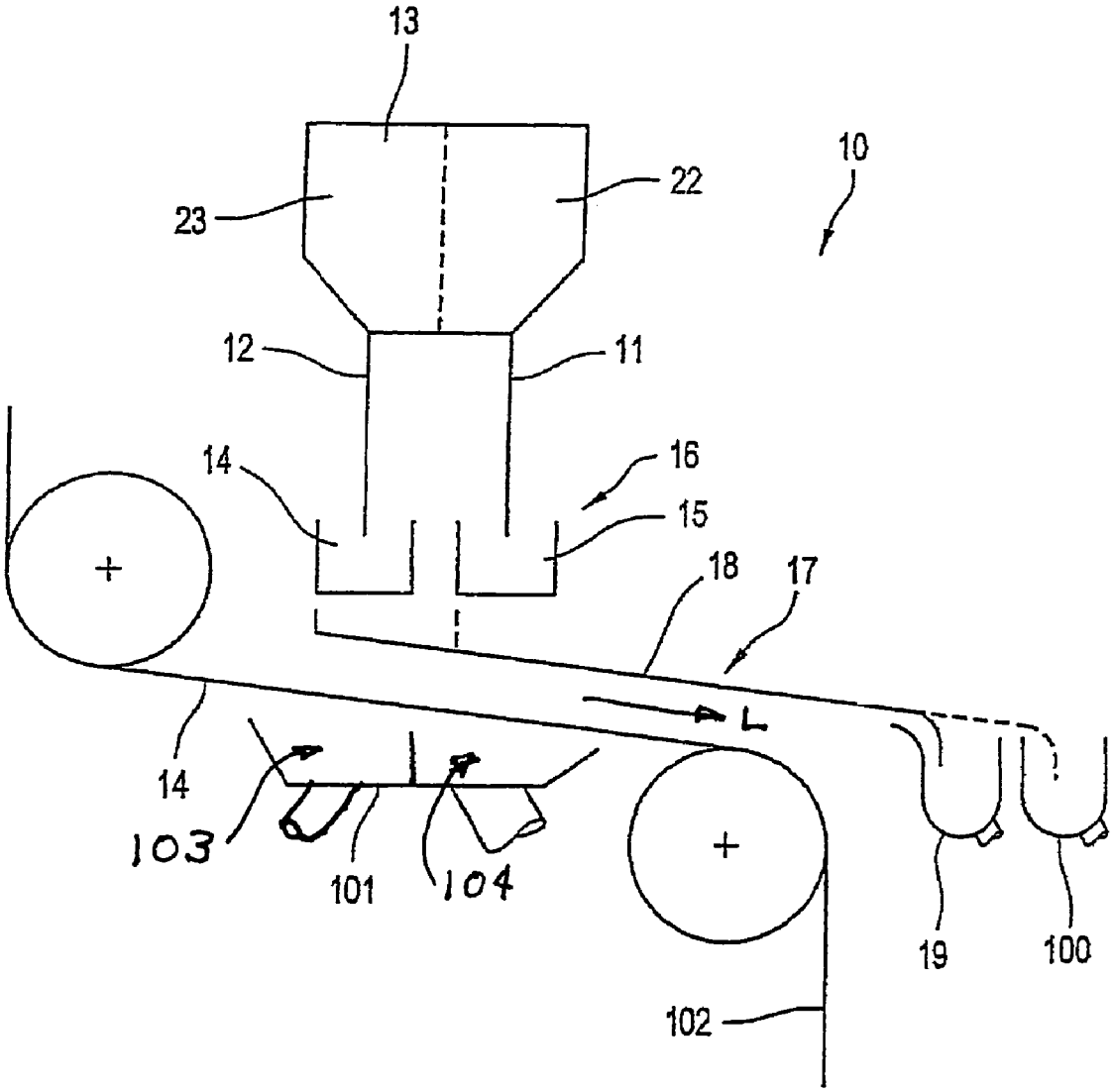
FIG. 1 shows a schematic view of one embodiment of the device according to the present invention.

Referring now to the drawings, and more particularly to FIG. 1 there is shown a device 10 for applying two application media forming a curtain 11 and 12. The application media are applied to a material web 102, here in a direct manner, by way of a curtain applicator 13 extending transversely over material web 102 to be coated. Under curtains 11 and 12 there is arranged a collecting device 16, which has two sections 14 and 15 and, like applicator 13, extend in transverse direction Q. Collecting device 16 collects the application media forming curtains 11 and 12 separately with sections 14 and 15. Since collecting device 16 collects each application medium separately, the application media cannot mix. The collected application media pass from collecting device 16 to a discharge device 17 extending in the longitudinal direction of material web 102. Discharge device 17 carries the collected application media away, in order that the latter can be used again for a further coating operation. Discharge device 17 has a discharge plate 18, at the end of which there are arranged separate drainage channels 19 and 100 for each application medium. In order to be able to carry away the application media as quickly as possible, discharge plate 18 has a gradient.

At the start or at the end of a coating operation, collecting device 16 is arranged above material web 102 and can be moved in the longitudinal direction of material web 102. In a further embodiment of the present invention, it is also possible for collecting device 16 and discharge device 17 to be formed in one piece. Collecting device 16 and Discharge device 17 can then be moved together. In another embodiment of the present invention, curtain applicator 13 can be moved along material web 102, so that collecting device 16 and discharge device 17 do not have to be moved at the start or at the end of the coating operation.

Under material web 102 there is arranged a lower collecting device 101. Lower collecting device 101 collects the application media following a break in material web 102. Using lower collecting device 101, a plurality of application media can preferably likewise be collected separately. For this purpose, lower collecting device 101 can be equipped with a separate channels 103 and 104 separate channels for each application medium.

Figure 2:
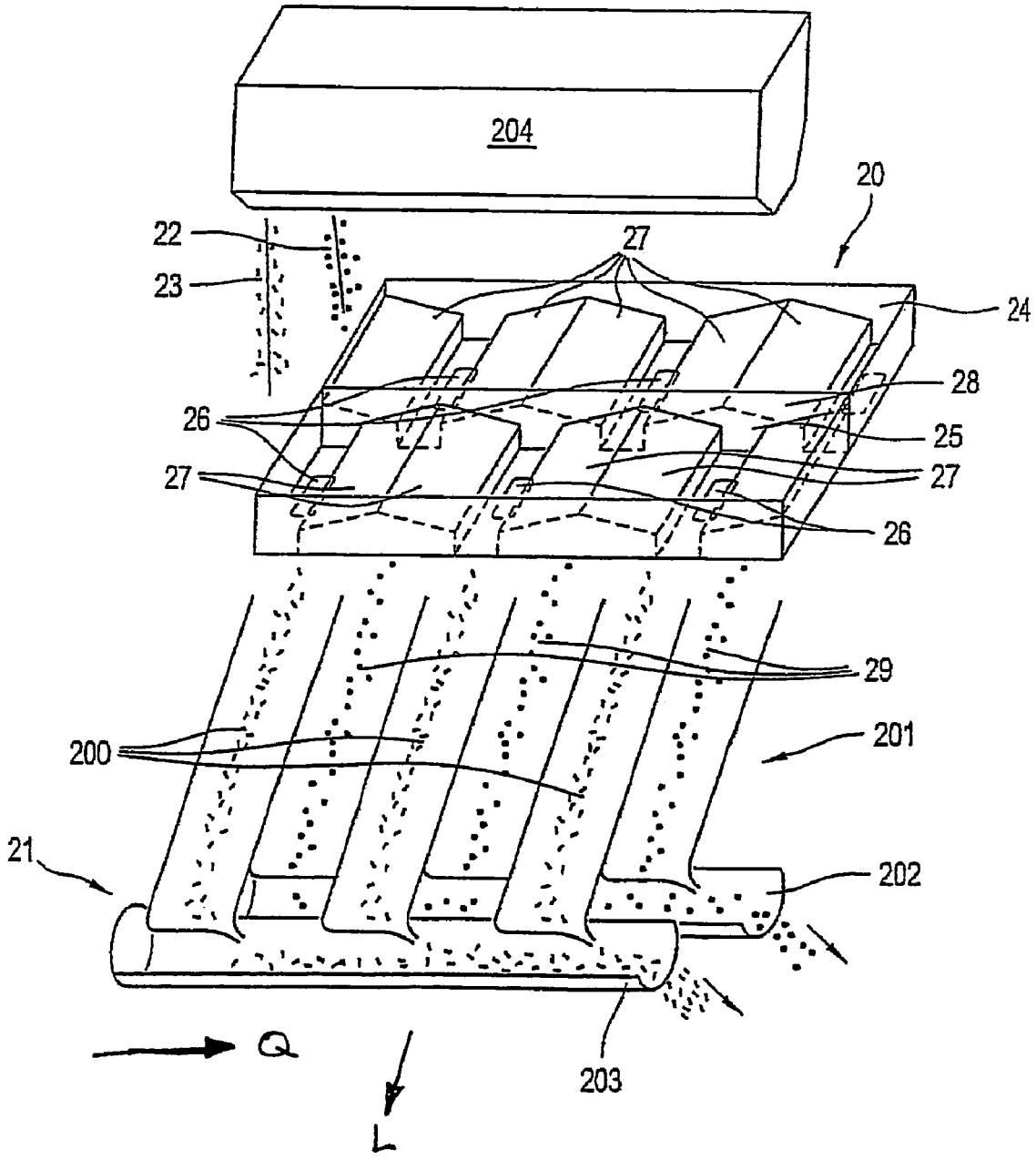
FIG. 2 shows a perspective view of an embodiment of a curtain applicator having a discharge device of the present invention.

Now, additionally referring to FIG. 2 there is shown a specific embodiment of the present invention including a collecting device 20 and a discharge device 21. An application medium 22, illustrated as dots, and an application medium 23, illustrated as dashes, fall from a curtain applicator 204 into collecting device 20 having two sections 24 and 25 arranged one after the other in the running direction of the material web. Sections 24 and 25 have a separating element 28 in order to prevent mixing of application media 22 and 23. In addition, sections 24 and 25 are provided with discharge openings 26. By way of discharge openings 26, application media 22 and 23 can be passed on to discharge device 21. Sections 24 and 25 are equipped with inclines 27. Inclines 27 pass on application media 22 and 23 to discharge openings 26. In addition, application medium 22, which falls into section 24, can flow through to discharge device 21 due to inclines 27 of adjacent section 25. Inclines 27 thus fulfill a further function, in that they permit application media 22 and 23 to cross without the crossing of application media 22 and 23 mixing with each other. Instead of the inclines, there can of course also be a curved shape.

Discharge device 21 has a discharge plate 201. Discharge plate 201 is provided with channels 29, in which application medium 22 runs away, and with channels 200, in which application medium 23 runs away. Thus, each of application media 22 and 23 can be carried away separately. At the end of discharge plate 201 there is provided drainage channels 202 and 203, in which application media 22 and 23 are carried away separately.

Channels 200, which run in a running direction L of material web 102, bridge drainage channel 202 extending in a transverse direction Q. Thus, application medium 23 crosses application medium 22 at the transition from discharge plate 201 to drainage channel 203. As a result of this crossing, mixing of the two application media is reliably ruled out.

Drainage channels 202 and 203 carry application media 22 and 23 away transversely with respect to the longitudinal direction L of material web 102. Discharge hoses 205 (here only indicated in FIG. 3), through which application media 22 and 23 are supplied to a storage container, can be connected to drainage channels 202 and 203.

Figure 3:
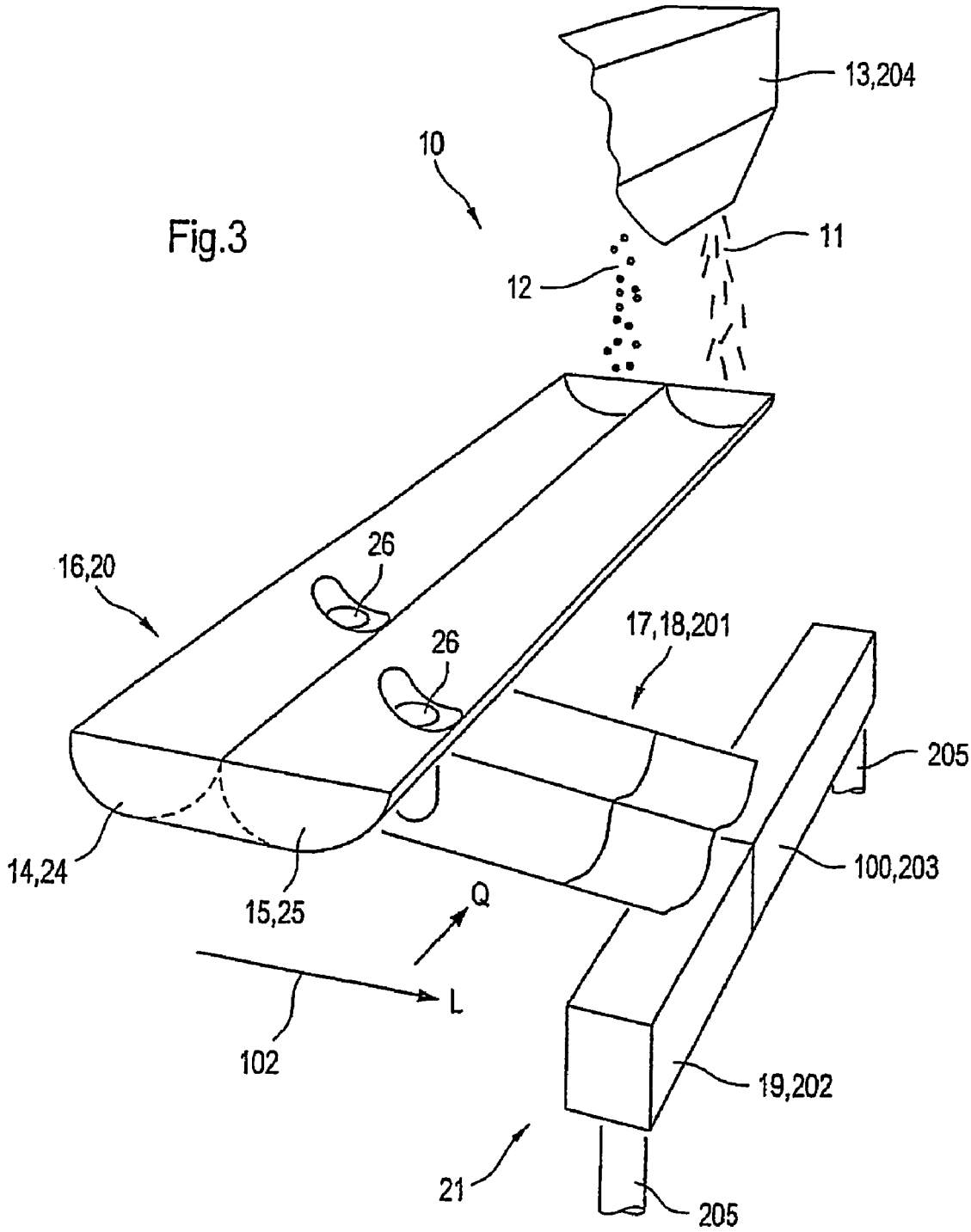
FIG. 3 is a perspective view of another embodiment of a collecting device of the present invention.

Now, additionally referring to FIG. 3, there is shown a device 10 in which drainage channels 19, 100, 202 and 203, seen in transverse direction Q of device 10, are arranged beside one another. Each of these drainage channels 19, 100, 202 and 203, separately from one another, pick up application medium 22 and 23 collected by a respective section 14, 15, 24 or 25 of collecting device 16 and 20 and passed on to discharge plates 18 and 201, respectively, from where it is discharged to the outside of device 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

10 Device
11, 12 Curtain
13, 204 Curtain applicator
102 Material web
14, 15, 24, 25 Section
16, 20 Collecting device
17, 21 Discharge device
18, 201 Discharge plate
19, 100, 202, 203 Drainage channel
101 Lower collecting device
103, 104 Separate channels
22, 23 Application medium
26 Discharge opening
27 Incline
29, 200 Channel
L Longitudinal direction
Q Transverse direction

The invention claimed is:

1. An application device for the application of at least two liquid application media to a moving surface, having a curtain applicator for applying the application media, the curtain applicator discharging at least two liquid application media as curtains moving substantially under the force of gravity, the device further comprising:

a collecting device for the separate collection of at least two application media, said collecting device being positionable between the curtain applicator and the moving surface, the curtain applicator and said collecting device being movable relative to each other; and a discharge device including a discharge plate at the end thereof is arranged a separate drainage channel for each of the at least two application media.

2. The device of claim 1, wherein said collecting device includes discharge openings which pass the application media to said discharge device, said moving surface being a material web.

3. The device of claim 2, wherein said collecting device is provided with inclines arranged above said discharge openings to lead the application media to said discharge openings.

4. The device of claim 2, wherein said collecting device is subdivided into a plurality of mutually adjacent sections, each of said sections holding only one of the at least two application media.

5. The device of claim 4, further comprising a separating element that separates said mutually adjacent sections from one another.

6. The device of claim 1, wherein said at least one separate channel of said discharge plate bridges at least one of said drainage channels.

7. The device of claim 1, wherein said drainage channels, seen in a transverse direction of the device, are arranged beside one another and each of said drainage channels separately from one another convey the application medium resulting from each respective said section of said collecting device and discharges it.

8. The device of claim 1, wherein said at least one channel of said discharge plate is a plurality of channels that are fabricated separately from one another.

9. The device of claim 1, wherein said at least one channel of said discharge plate is a plurality of channels having a cross-sectional shape, said channels of said discharge plate being lined up beside each other in a row.

10. The device of claim 1, wherein at least one of said discharge plate and said at least one channel of said discharge plate have a gradient, said drainage channel having a gradient.

11. The device of claim 1, wherein the application media is carried away to a side of the collection device.

12. The device of claim 1, wherein said collecting device and said discharge device are formed as one piece.

13. The device of claim 1, wherein said collecting device and said discharge device are separate components.

14. The device of claim 1, wherein said collecting device has two sections which can be moved in opposite directions relative to a longitudinal direction of the movement of the moving surface.

15. The device of claim 1, further comprising a lower collecting device arranged under the moving surface.

16. The device of claim 15, wherein the application media is collectable separately from said collecting device by said lower collecting device.

17. An application device, for the application of at least two liquid application media to a moving surface, having a curtain applicator for applying the application media, the curtain applicator discharging at least two liquid application media as curtains moving substantially under the force of gravity, the device further comprising:

a collecting device for the separate collection of at least two application media, said collecting device being positionable between the curtain applicator and the moving surface, the curtain applicator and said collecting device being movable relative to each other;

a discharge device assigned to said collecting device, said collecting device including discharge openings which pass the application media to said discharge device, said collecting device being subdivided into a plurality of mutually adjacent sections, each of said sections holding only one of the at least two application media; and a separating element that separates said mutually adjacent sections from one another, said separating element is formed by said mutually adjacent sections that each have channels with curved longitudinal wall surfaces which meet one another in a transverse machine direction.

18. An application device for the application of at least two liquid application media to a moving surface, having a curtain applicator for applying the application media, the curtain applicator discharging at least two liquid application media as curtains moving substantially under the force of gravity, the device further comprising:

a collecting device for the separate collection of at least two application media, said collecting device being positionable between the curtain applicator and the moving surface, the curtain applicator and said collecting device being movable relative to each other; and a discharge device assigned to said collecting device, said collecting device including discharge openings which pass the application media to said discharge device, said collecting device is subdivided into a plurality of mutually adjacent sections, each of said sections holding only one of the at least two application media, said discharge openings of one of said mutually adjacent sections are offset in relation to said discharge openings of an adjacent one of said mutually adjacent sections.

* * * * *